US009572428B2

(12) United States Patent
Seeley

(10) Patent No.: US 9,572,428 B2
(45) Date of Patent: Feb. 21, 2017

(54) CONCEALED VERTICAL ADJUSTMENT MECHANISM FOR KITCHEN APPLIANCE STORAGE MEMBERS

(71) Applicant: Whirlpool Corporation, Benton Harbor, MI (US)

(72) Inventor: Michael S. Seeley, South Haven, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/665,094

(22) Filed: Mar. 23, 2015

(65) Prior Publication Data

US 2016/0278519 A1 Sep. 29, 2016

(51) Int. Cl.

| | |
|---|---|
| ***A47B 96/04*** | (2006.01) |
| ***A47B 57/32*** | (2006.01) |
| ***A47B 96/02*** | (2006.01) |
| ***A47B 77/00*** | (2006.01) |
| ***F25D 25/02*** | (2006.01) |

(52) U.S. Cl.

CPC ..... *A47B 57/32* (2013.01); *A47B 77/00* (2013.01); *A47B 96/021* (2013.01); *F25D 25/024* (2013.01)

(58) Field of Classification Search

CPC ..... F25D 23/04
USPC ..... 108/106–109; 312/190, 207, 193, 187; 248/243–246
See application file for complete search history.

(56) References Cited

U.S. PATENT DOCUMENTS 3,158,349 A * 11/1964 Bergstrom ..... A47B 57/30 211/134
3,450,270 A * 6/1969 Brown ..... A47B 57/425 211/187
4,892,200 A * 1/1990 Alperson ..... A47B 57/42 211/190

(Continued)

FOREIGN PATENT DOCUMENTS

CN 202119197 1/2012
CN 203629194 6/2014

(Continued)

*Primary Examiner* — Matthew Ing

(57) ABSTRACT

A storage member vertical adjustment mechanism for an appliance includes a concealed vertical track system that is positioned within an appliance cabinet. The vertical track system includes a retaining member and a concealing flange that extends parallel with and conceals the retaining member with an adjustment region defined therebetween. A storage member has an engagement structure that cooperatively engages the adjustment region. The engagement structure includes a laterally-extending vertical flange that engages the concealing flange and the retaining member in a vertical adjustment state and alternatively engages the retaining member in the vertically secured positions. The retaining member and the concealing flange laterally support the laterally-extending vertical flange within the adjustment region such that the engagement structure of the storage member is selectively inserted and removed from the adjustment region through one of the top and bottom receiving apertures of the adjustment region.

17 Claims, 12 Drawing Sheets

(56) References Cited

U.S. PATENT DOCUMENTS

| | | | | | |
|---|---|---|---|---|---|
| 5,277,393 | A * | 1/1994 | Nicholson | A47B 95/008 | 108/108 |
| 5,975,318 | A * | 11/1999 | Jay | A47F 5/101 | 211/150 |
| 7,107,785 | B2 * | 9/2006 | Barmann et al. | A47B 57/562 | 62/404 |
| 8,042,892 | B2 * | 10/2011 | Benz | A47B 57/562 | 108/108 |
| 8,297,575 | B2 * | 10/2012 | Kluge | A47B 96/1466 | 248/235 |
| 2008/0030114 | A1 * | 2/2008 | Becke | A47B 57/425 | 312/408 |

FOREIGN PATENT DOCUMENTS

| | | | |
|---|---|---|---|
| DE | 102010004219 | * | 9/2010 |
| IN | 200704955 | | 1/2008 |
| KR | 100775822 | | 11/2007 |

* cited by examiner

CONCEALED VERTICAL ADJUSTMENT MECHANISM FOR KITCHEN APPLIANCE STORAGE MEMBERS

FIELD OF THE INVENTION

The present invention generally relates to storage members disposed within kitchen appliances, and more specifically, concealed adjustment mechanisms for moving storage members within kitchen appliances.

BRIEF SUMMARY OF THE INVENTION

In at least one aspect, a storage member vertical adjustment mechanism for a kitchen appliance includes an appliance cabinet having a plurality of sidewalls and a back wall that define an interior volume, one or more cabinet doors having an interior surface and an exterior surface and the one or more cabinet doors are coupled to the appliance cabinet and operable between open and closed positions. The cabinet door in the closed position encloses at least a part of the interior volume of the appliance cabinet such that the interior surface of the cabinet door further defines the interior volume. A concealed vertical track system is positioned within at least one of the back wall of the appliance cabinet and the interior surface of the cabinet door. The vertical track system includes a retaining member and a concealing flange that extends parallel with the retaining member and at least partially conceals the retaining member when viewed from outside of the interior volume when the door is in the open position. An adjustment region is defined between an outward surface of the retaining member and an inward surface of the concealing flange. The adjustment region includes a top receiving aperture and a bottom receiving aperture. A storage member having an engagement structure cooperatively engages the adjustment region of the vertical track system. The engagement structure includes a laterally extending vertical flange that engages at least one of the inward surface of the concealing flange and the outward surface of the retaining member to define a vertical adjustment state and alternatively engages the outward surface of the retaining member to define a plurality of vertically secured positions. The vertical adjustment state and the plurality of vertically secured positions are defined by the concealing flange concealing the engagement structure from view. The retaining member and the concealing flange laterally support the laterally extending vertical flange within the adjustment region such that the engagement structure of the storage member can be selectively inserted and removed from the adjustment region only via at least one of the top and bottom receiving apertures.

In at least another aspect, a storage member vertical adjustment mechanism includes a concealed vertical track system configured to be positioned within a kitchen appliance. The vertical track system includes a retaining member and a concealing flange that cooperate to define an adjustment region. A plurality of securing structures are defined within the retaining member and are in communication with the adjustment region. The retaining member and the concealing flange are positioned parallel with one another such that the concealing flange at least partially conceals the plurality of securing structures from view when viewed at a position substantially normal to an outer surface of the concealing flange. The concealing flange and retaining member cooperate to define first and second ends of the adjustment region. A storage member has an engagement structure that cooperatively engages the adjustment region of the vertical track system, wherein the engagement structure includes a laterally extending vertical flange that engages at least one of the inward surface of the concealing flange and the outward surface of the retaining member to define a vertical adjustment state and alternatively engages a portion of the plurality of securing structures of the retaining member to define a plurality of vertically secured positions. The vertical adjustment state and the plurality of vertically secured positions are defined by the concealing flange concealing the engagement structure from view. The retaining member and the concealing flange define a vertical slot through which the engagement structure can vertically operate within the adjustment region, the vertical slot having a slot width that is less than a thickness of the engagement structure such that the engagement structure of the storage member is selectively inserted and removed from the adjustment region only via at least one of the first and second ends of the adjustment region.

In at least another aspect, a storage member vertical adjustment mechanism for a kitchen appliance includes an appliance cabinet having a plurality of sidewalls and a back wall that define an interior volume. A cabinet door has an interior surface and an exterior surface. The cabinet door is coupled to the appliance cabinet and operable between open and closed positions, wherein the cabinet door in the closed position encloses the interior volume of the appliance cabinet such that the interior surface of the cabinet door further defines the interior volume. A concealed vertical track system is positioned within at least one of the back wall of the appliance cabinet, a sidewall of the appliance cabinet and the interior surface of the cabinet door. The vertical track system includes a retaining member, a concealing flange and a transition member that extends between the retaining member and the concealing flange, wherein the concealing flange is positioned offset from and parallel with the retaining member and at least partially conceals the retaining member at least when viewed from outside of the interior volume when the cabinet door is in the open position. An adjustment region has a vertical gap and top and bottom receiving apertures are defined by the retaining member and the concealing flange. A storage member has an engagement structure that cooperatively engages the adjustment region of the vertical track system, wherein the engagement structure includes a laterally extending vertical flange that is configured to be inserted into and removed from the adjustment region via at least one of the top and bottom receiving apertures. When the laterally extending vertical flange is positioned within the adjustment region, the laterally extending vertical flange extends through the vertical gap to a container region of the storage member such that the laterally extending vertical flange is laterally secured within the adjustment region. The laterally extending vertical flange engages the outward surface of the retaining member to define a plurality of vertically secured positions and wherein the laterally extending vertical flange is operable toward the inward surface of the concealing flange to define an adjustment state wherein the laterally extending vertical flange is vertically operable within the adjustment region and laterally operable within the adjustment region into any one of the vertically secured positions. The vertical adjustment state and the plurality of vertically secured positions are each defined by the concealing flange, which conceals the laterally extending vertical flange from view.

These and other features, advantages, and objects of the present invention will be further understood and appreciated by those skilled in the art by reference to the following specification, claims, and appended drawings.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings, certain embodiment(s) which are presently preferred. It should be understood, however, that the invention is not limited to the precise arrangements and instrumentalities shown. Drawings are not necessary to scale. Certain features of the invention may be exaggerated in scale or shown in schematic form in the interest of clarity and conciseness.

DETAILED DESCRIPTION

Figure 1:
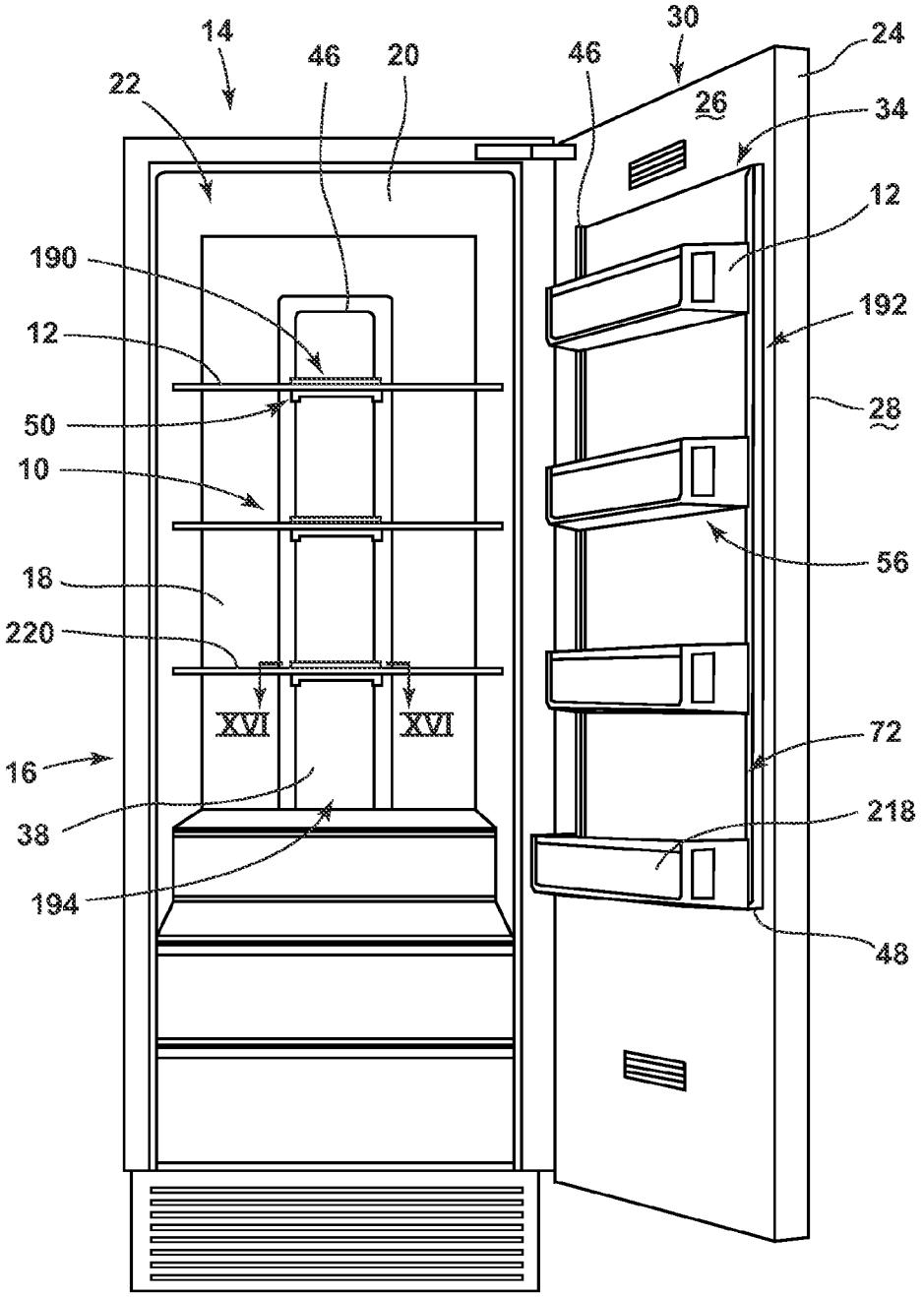
FIG. 1 is a front perspective view of a refrigerating appliance with the appliance door in an open position and an aspect of the concealed vertical adjustment mechanism disposed within the cabinet door and another aspect of the concealed vertical adjustment mechanism disposed within a back wall of the appliance.
Figure 2:
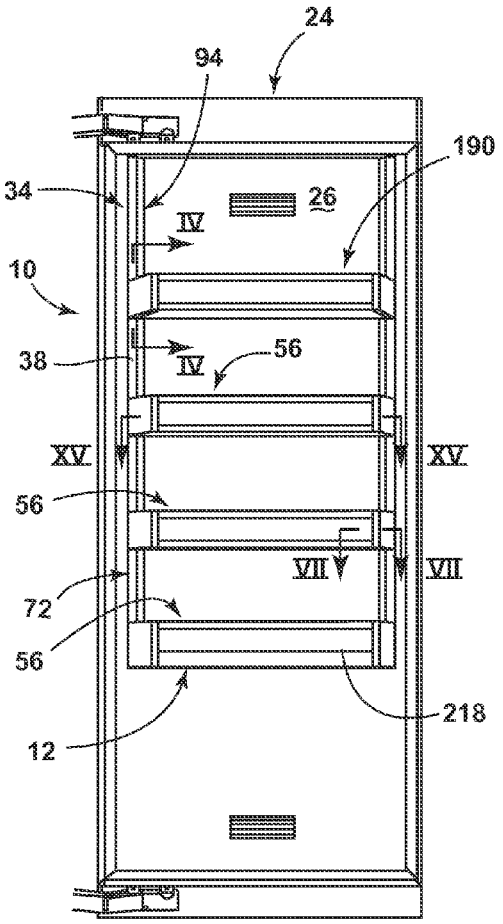
FIG. 2 is an inside elevational view of the appliance door of FIG. 1.
Figure 3:
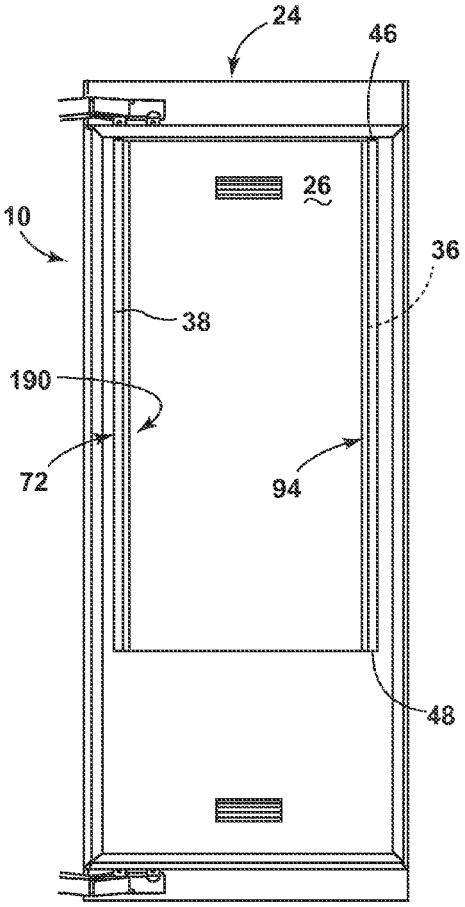
FIG. 3 is an inside elevational view of the appliance door of FIG. 2 with the storage bins removed.

Before the subject invention is described further, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

In this specification and the appended claims, the singular forms "a," "an" and "the" include plural reference unless the context clearly dictates otherwise.

With respect to FIGS. 1-10, reference numeral 10 generally refers to a concealed vertical adjustment mechanism for vertically adjusting storage members 12 that are disposed within a kitchen appliance 14, according to one embodiment. The concealed vertical adjustment mechanism 10 can include an appliance cabinet 16 having a plurality of sidewalls 18 and a back wall 20 that cooperate to define an interior volume 22. A cabinet door 24 having an interior surface 26 and an exterior surface 28 is coupled to the appliance cabinet 16 and is operable between an open position 30 and a closed position (not shown). The cabinet door 24 in the closed position encloses the interior volume 22 of the appliance cabinet 16 such that the interior surface 26 of the cabinet door 24 further defines the interior volume 22 of the appliance cabinet 16.

A concealed vertical track system 34 is positioned within at least one of the back wall 20 of the appliance cabinet 16, one of the sidewalls 18 of the appliance cabinet 16 and the interior surface 26 of the cabinet door 24. The vertical track system 34 includes a retaining member 36 and a concealing flange 38 that extends parallel with the retaining member 36. The concealing flange 38 at least partially conceals the retaining member 36 when viewed from outside the interior volume 22, external of the kitchen appliance 14 and at least when the cabinet door 24 is in the open position 30. More typically, the vertical track system 34 for affixing one or more bins, shelves, or combinations thereof, are at least substantially or completely concealed from the user during normal operation of the appliance 14. An adjustment region 40 of the concealed vertical track system 34 is defined between an outward surface 42 of the retaining member 36 and an inward surface 44 of the concealing flange 38. The adjustment region 40 includes a top receiving aperture 46 and a bottom receiving aperture 48.

Referring again to FIGS. 1-10, in particular, FIGS. 7 and 8, the storage member 12 includes an engagement structure 50 that cooperatively engages the adjustment region 40 of the concealed vertical track system 34. The engagement structure 50 includes a laterally extending vertical flange 52 that engages at least one of the inward surface 44 of the concealing flange 38 and the outward surface 42 of the retaining member 36 to define a vertical adjustment state 54. Alternatively, the laterally extending vertical flange 52 engages the outward surface 42 of the retaining member 36 to define a plurality of vertically secured positions 56. The vertical adjustment state 54 and the plurality of vertically secured positions 56 are defined by the concealing flange 38 concealing the engagement structure 50 from view. It is contemplated that the various movements of the storage member 12, between the various vertically secured positions 56 and the vertical adjustment state 54 can be accomplished by hand and without the use of tools. The retaining member 36 and the concealing flange 38 are also configured to laterally support the laterally extending vertical flange 52 at least partially within the adjustment region 40. In this manner, the engagement structure 50 of the storage member 12 can be selectively inserted and removed from the adjustment region 40 only via at least one of the top and bottom receiving apertures 46, 48. This insertion and removal of the storage member 12 from the adjustment region 40 and through the adjustment region 40 can be accomplished, in various embodiments, by hand and without the use of tools.

Referring again to FIGS. 7-10, according to the various embodiments, the retaining member 36 and the concealing flange 38 of the concealed vertical track system 34 can be connected by a transition member 70 that extends between the retaining member 36 and the concealing flange 38. The retaining member 36, the concealing flange 38, and the transition member 70 can be part of a unitary and co-extruded track member 72 that extends vertically within the interior volume 22 of the appliance to retain the various storage members 12 of the concealed vertical adjustment mechanism 10. It is contemplated that the concealed vertical track system 34 can include two opposing co-extruded track members 72 vertically positioned in a parallel configuration relative to one another within the interior volume 22 of the kitchen appliance 14. It is contemplated that the engagement structure 50 of the storage member 12 can include first and second laterally extending vertical flanges 80, 82 that cooperatively engage each of the adjustment regions 40 of the two opposing co-extruded track members 72, respectively.

Referring again to FIGS. 1, 2 and 7-10, it is contemplated that the retaining member 36 and concealing flange 38 of the co-extruded track member 72 can include a retaining member edge 90 and a concealing flange edge 92, respectively, that define both the top and bottom receiving apertures 46, 48 and also defines a vertical gap 94 extending along the length of the co-extruded track member 72. The gap width 96 of the gap defined between the retaining member 36 and the concealing flange 38 is configured to be less than the flange thickness 98 of the laterally extending vertical flange 52 of the engagement structure 50 such that the laterally extending vertical flange 52 can only be inserted into the adjustment region 40 via the top and bottom receiving apertures 46, 48. In this manner, once the laterally extending vertical flange 52 is disposed within the adjustment region 40, only vertical adjustment of the storage member 12 is substantially permitted. Limited lateral and rotational movement are allowed within the adjustment region 40 to move the storage member 12 between the vertical adjustment state 54 and the plurality of vertically secured positions 56. However, the configuration of the vertical gap 94 defined between the edges of the retaining member edge 90 and the concealing flange edge 92 prevents lateral movement of the laterally extending vertical flange 52 out from the adjustment region 40 through the vertical gap 94. Accordingly, the vertical gap 94 between the retaining member edge 90 and the concealing flange edge 92 serves to guide the vertical movement 100 of the storage member 12 within the concealed vertical adjustment mechanism 10.

It is contemplated that the concealed vertical adjustment mechanism 10 can be recessed within a portion of the wall of the kitchen appliance 14, such as within the cabinet door 24 or within the sidewall 18 (see FIGS. 1-12) or back wall 20 (see FIGS. 13-16) of the appliance cabinet 16. In this manner, the recessed configuration of the co-extruded track members 72 can serve to further define the dimensions of the vertical gap 94 defined between the retaining member 36 and the concealing flange 38. In such an embodiment, where the co-extruded track members 72 are recessed within the wall of the appliance, the laterally extending vertical flange 52 can be included within an engagement channel 110 defined within the engagement structure 50. Accordingly, the engagement channel 110 can be configured to wrap around at least a portion of or substantially all or all of a concealing flange 38. In this manner, the engagement channel 110 and the channel-type structure formed by the retaining member 36, concealing flange 38 and transition member 70, form opposing and interlocking channels that cooperate to secure the storage member 12 within the opposing co-extruded track members 72. Additionally, where the engagement channel 110 is implemented, the laterally extending vertical flange 52 can be offset behind a storage portion 120 of the storage member 12, such that an outside extent 118 of the storage portion 120 of the storage member 12 is substantially even with an outside edge 122 of the engagement channel 110. This configuration can serve to further conceal the concealed vertical adjustment mechanism 10 from view by a user standing outside of the kitchen appliance 14.

Referring again to FIGS. 1-10, according to the various embodiments, the retaining member 36 of the concealed vertical track system 34 can include a plurality of retaining apertures 130 defined therein. The engagement structure 50 of the storage member 12 can include at least one protrusion 132 that is selectively received by a portion of the plurality of retaining apertures 130. In this manner, the engagement of the protrusion 132 of the engagement structure 50 and the various retaining apertures 130 of the retaining member 36 can serve to define each of the plurality of vertically secured positions 56. It is contemplated that the engagement structure 50 can include a single protrusion 132 that engages one of the retaining apertures 130, or can include two, three, or more protrusions 132 that are vertically aligned to engage two, three, or more corresponding retaining apertures 130 defined within the retaining member 36. It is contemplated that where the engagement structure 50 includes three or more protrusions 132 that are vertically aligned, it is not necessary that each of the protrusions 132 engages a cooperating retaining aperture 130 of the retaining member 36 in order to be secured in one of the vertically secured positions 56.

Figure 12:
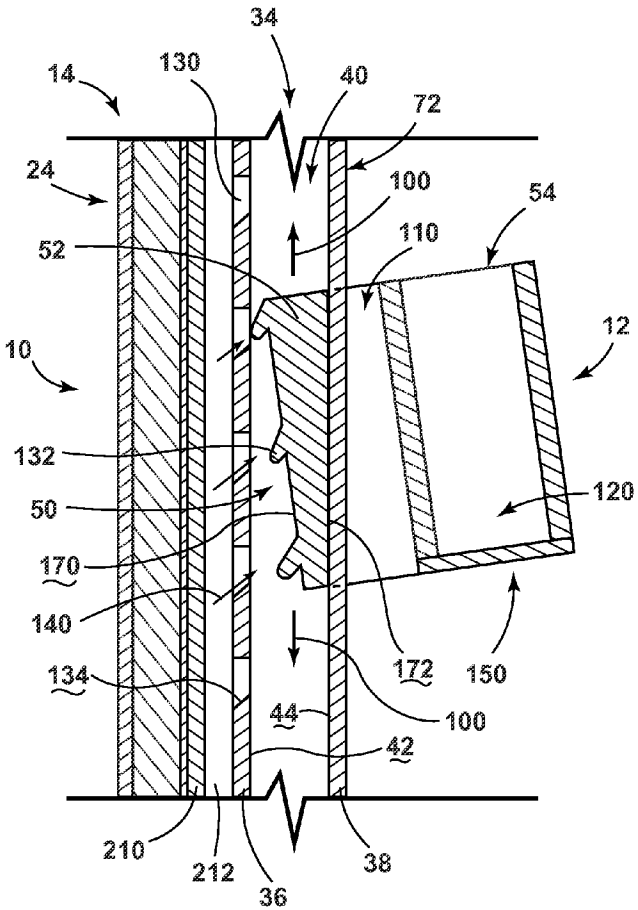
FIG. 12 is a schematic cross-sectional view of the storage bin of FIG. 7 in the vertical adjustment state.
Figure 11:
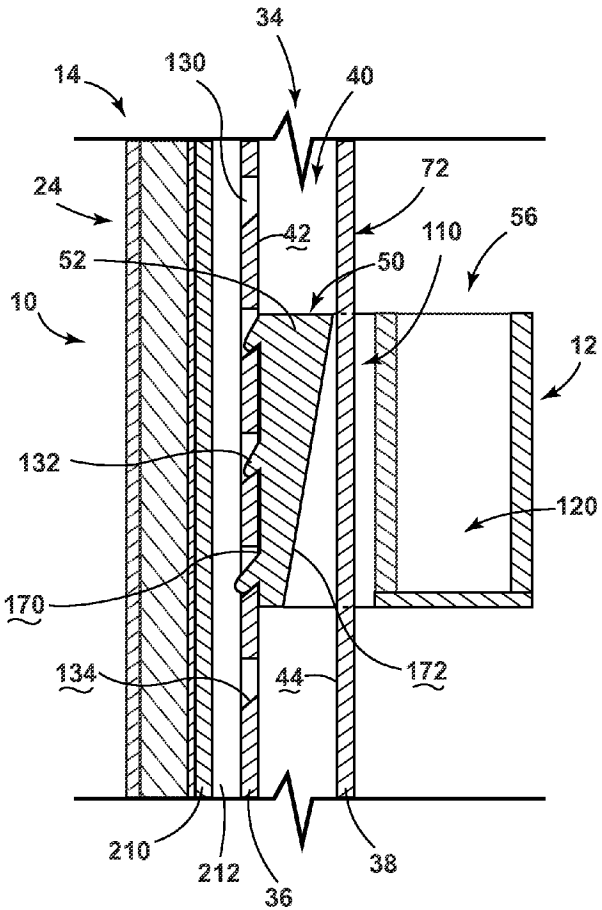
FIG. 11 is a schematic cross-sectional view of an alternate embodiment of a storage member in one of the vertically secured positions.
Figure 13:
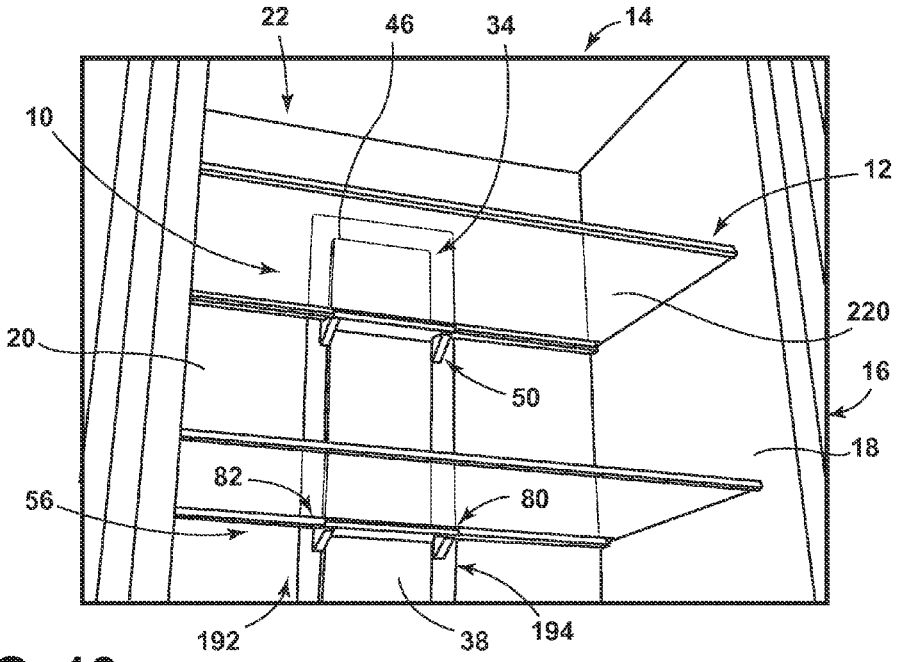
FIG. 13 is an enlarged perspective view of a refrigerating appliance illustrating an aspect of the concealed vertical adjustment mechanism disposed within a back wall of the refrigerating appliance.
Figure 14:
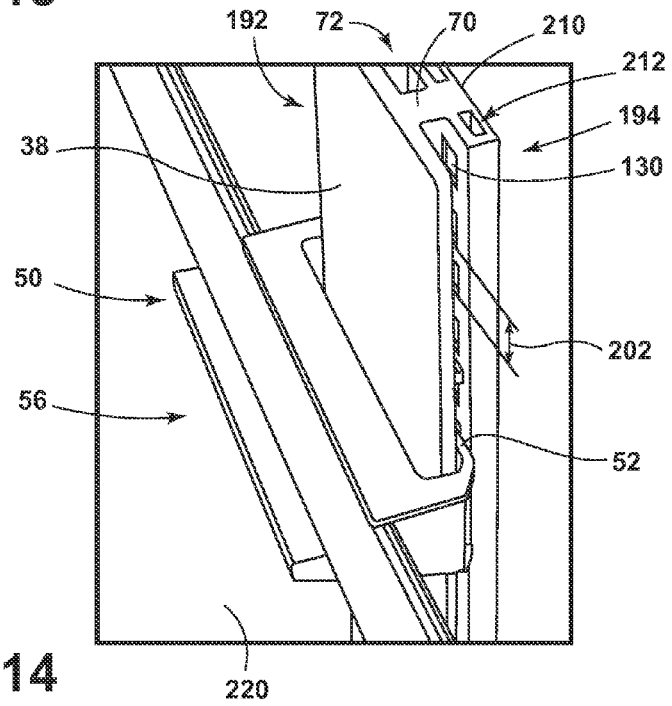
FIG. 14 is a top perspective view of another aspect of the concealed vertical adjustment mechanism incorporating vertically adjustable shelves.

According to the various embodiments, the retaining aperture 130 can include a sloped surface 134 shown in FIGS. 11 and 12, defined therein. The sloped surface 134 can include an angle that substantially matches an angle of the protrusion 132. Accordingly, the angle of the protrusion 132 can substantially cooperate with the sloped surface 134 of the retaining aperture 130 to selectively secure the storage member 12 in one of the vertically secured positions 56.

By way of example, and not limitation, where the engagement structure 50 includes three or more protrusions 132 that are vertically aligned and extend from the laterally extending vertical flange 52, the storage member 12 can be positioned at a topmost or bottom most position near the top and bottom receiving apertures 46, 48. The top most position of the vertically secured positions 56 can be defined by two or more of the lower protrusions 132 engaging the top two corresponding retaining apertures 130 of the retaining member 36, and at least one protrusion 132 extending above the top receiving aperture 46 defined by the co-extruded track member 72. Through the engagement of at least two of the protrusions 132 with the corresponding retaining apertures 130, the storage member 12 can be secured within one of the vertically secured positions 56. Similarly, where the storage member 12 is positioned within a bottom most vertically secured position 56, the lowest protrusion 132 of the various protrusions 132 extending from a portion of the laterally extending vertical flange 52 of the engagement structure 50 can be positioned below the bottom receiving aperture 48 such that it does not engage or enter into any corresponding retaining aperture 130.

Figure 5:
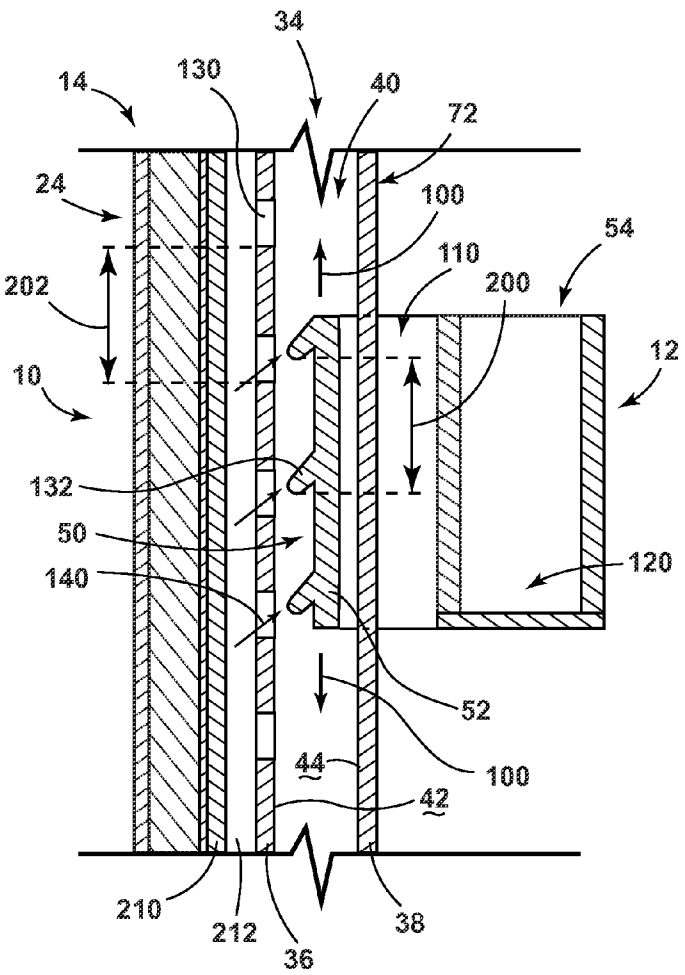
FIG. 5 is a cross-sectional view of the appliance door of FIG. 4 with the storage member in a vertical adjustment state and removed from engagement with the appliance door.
Figure 4:
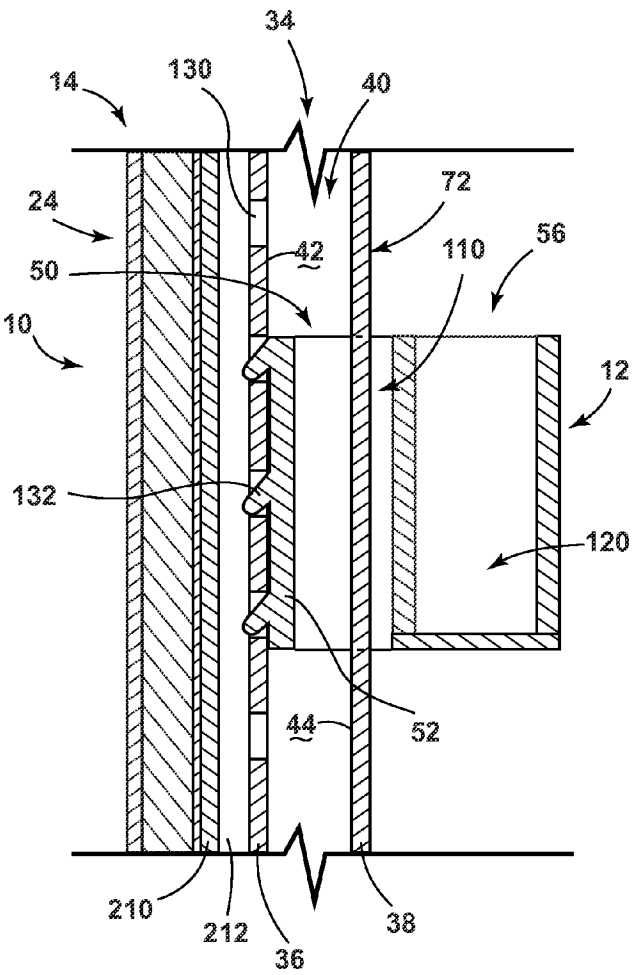
FIG. 4 is a cross-sectional view of the appliance door of FIG. 2 taken along line IV-IV, with the storage bin in one of the vertically secured positions.
Figure 7:
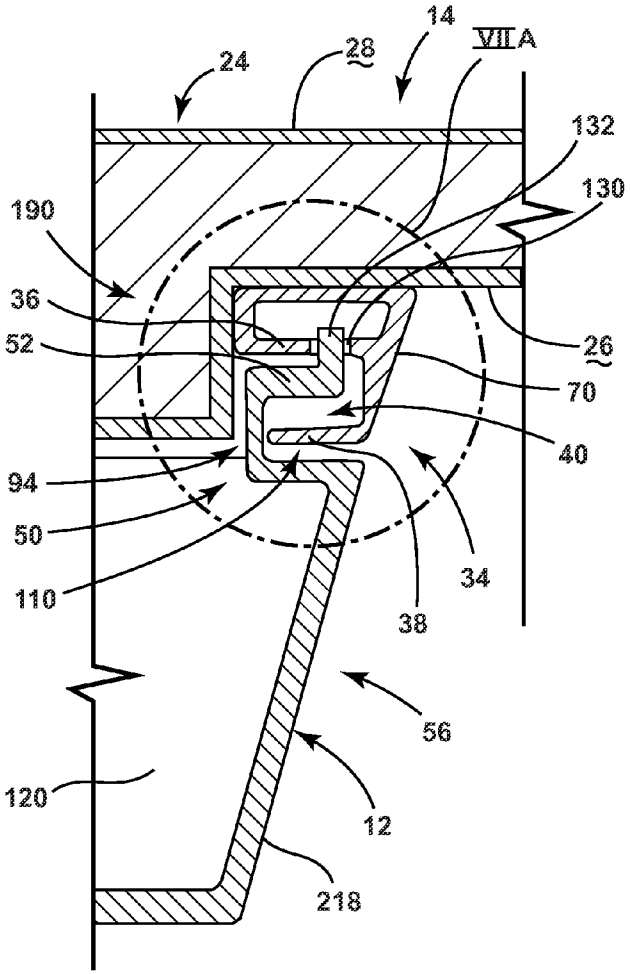
FIG. 7 is a cross-sectional view of the appliance door of FIG. 2 taken along line VII-VII.
Figure 6:
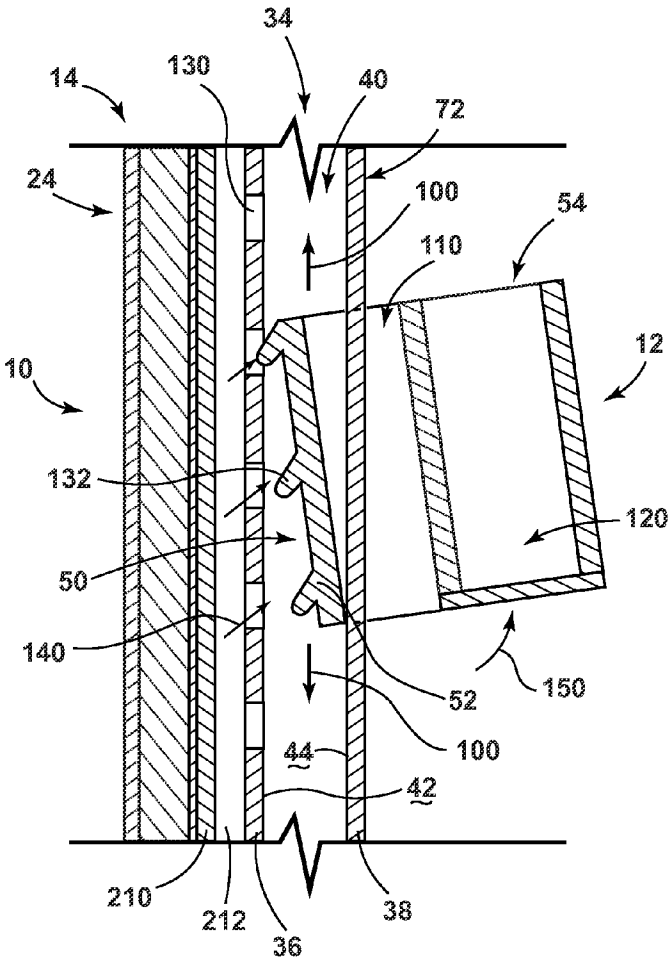
FIG. 6 is a cross-sectional view of the appliance door of FIG. 5, with the storage member in an alternative aspect of the vertical adjustment state.
Figure 7A:
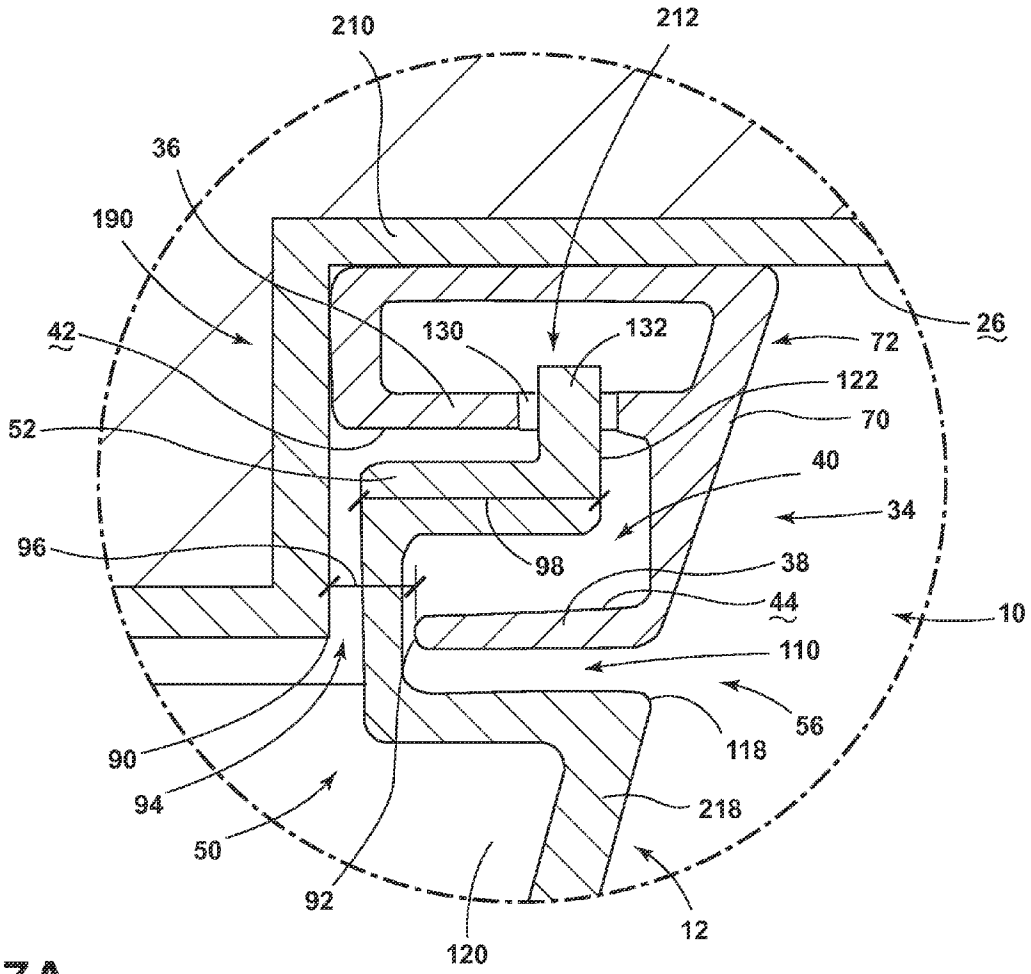
FIG. 7A is an enlarged cross-sectional view of the appliance door of FIG. 7, taken at area VIIA.

Referring now to the embodiment illustrated in FIGS. 4-6, it is contemplated that the outward movement 140 of the engagement structure 50 from any one of the vertically secured positions 56 to the adjustment state serves to disengage the one or more protrusions 132 from the corresponding retaining aperture 130 or apertures, such that the engagement structure 50 can be vertically operated within the adjustment region 40. The outward movement 140 of the storage member 12 from one of the vertically secured positions 56 to the adjustment state can be accomplished by sliding the entire storage member 12 in a substantially horizontal direction, and, in some embodiments, in a slightly upward direction, in order to disengage the various protrusions 132 of the engagement structure 50 from the corresponding retaining apertures 130 of the retaining member 36.

It is also contemplated, as illustrated in FIGS. 4 and 6, that the storage member 12 can be moved by an upward rotation 150 such that the laterally extending vertical flange 52 is at least partially rotated within the adjustment region 40. This upward rotation 150 of the laterally extending vertical flange 52 within the adjustment region 40 serves to remove the various protrusions 132 from the corresponding engagement apertures defined by the retaining member 36. Once rotated to the adjustment state, the laterally extending vertical flange 52 is substantially free to slidably engage the adjustment region 40 such that the storage member 12 is substantially free within the vertical adjustment state 54, to vertically operate through the concealed vertical adjustment mechanism 10 to either be removed from the concealed vertical adjustment mechanism 10 or to be relocated to another vertically secured position 56.

Referring again to the embodiment illustrated in FIGS. 4 and 6, once the storage member 12, being in the adjustment state, is moved toward the desired vertically secured position 56, the storage member 12 can then be rotated downward such that the downward rotation of the storage member 12, and in turn, the laterally extending vertical flange 52, causes the various protrusions 132 extending from the laterally extending vertical flanges 52 to enter into corresponding retaining apertures 130 of the retaining member 36. Once engaged, the protrusions 132 and the corresponding retaining apertures 130 again define one of the vertically secured positions 56.

According to the various embodiments, it is contemplated that the retaining apertures 130 of the concealed vertical adjustment mechanism 10 can be defined within the laterally extending vertical flange 52, as opposed to the retaining member 36. In such an embodiment, it is contemplated that the retaining member 36 can include a set of protrusions 132 that extend outward, and, in certain embodiments, at least partially upward, such that protrusions 132 defined within the retaining member 36 can engage corresponding retaining apertures 130 defined within the laterally extending vertical flange 52. According to various alternate embodiments, it is contemplated that the retaining member 36 and the laterally extending vertical flange 52 can each include cooperating structures that extend toward one another and matingly engage one another, to define each of the vertically secured positions 56. In each of these embodiments, it is contemplated that the storage member 12 can be moved from the vertically secured position 56 to the adjustment state by at least one of upward rotation 150 of the storage member 12 and/or moving the entire storage member 12 outward and toward the concealing flange 38.

According to the various embodiments, as exemplified in FIGS. 4 and 6, it is contemplated that each of the plurality of vertically secured positions 56 is at least partially defined by the engagement structure 50 being substantially parallel with the concealing flange 38 and the retaining member 36. When the engagement structure 50 is moved to the adjustment state, it is contemplated that the adjustment state can be defined by the engagement structure 50 being rotated to be out of parallel with the concealing flange 38 and the retaining member 36.

According to various alternate embodiments, as exemplified in FIGS. 11 and 12, it is contemplated that the laterally extending vertical flange 52 can include a substantially trapezoidal cross section that limits the outward lateral movement of the laterally extending vertical flange 52 in the direction of the concealing flange 38. In such an embodiment, it is contemplated that only rotation of the storage member 12 can serve to move the laterally extending vertical flange 52 from one of the vertically secured positions 56 to the adjustment state in order to vertically adjust the position of the storage member 12 within the concealed vertical adjustment mechanism 10.

Referring again to FIGS. 11 and 12, it is contemplated that a retaining-member side 170 of the laterally extending vertical flange 52, which can include the protrusions 132, can be parallel with the retaining member 36 when the laterally extending vertical flange 52 is in one of the vertically secured positions 56. In this position, the concealment-flange side 172 of the laterally extending vertical flange 52 is substantially out of parallel with the concealing flange 38. Alternatively, when the storage member 12 is moved, by the upward rotation 150, to the vertical adjustment state 54, the retaining-member side 170 of the laterally extending vertical flange 52 is moved to be out of parallel with the retaining member 36 such that the protrusions 132 are rotated out of engagement with the retaining apertures 130 of the retaining member 36. In the vertical adjustment state 54, the concealing-flange side 172 of the laterally extending vertical flange 52 is moved to be in parallel alignment with the concealing flange 38, such that the concealment-flange side 172 of the laterally extending vertical flange 52 can slidably engage the inward surface 44 of the concealing flange 38 to be vertically operated within the adjustment region 40.

Referring now to the embodiments illustrated in FIGS. 1, 2 and 13-16, it is contemplated that a concealed vertical track system 34 can include two opposing co-extruded track members 72 for securing the storage member 12 within one of the vertically secured positions 56 and also moving the storage member 12 while in the vertical adjustment state 54. Where two opposing co-extruded track members 72 are included, first and second laterally extending vertical flanges 80, 82 of the storage member 12 can cooperatively engage the two opposing co-extruded track members 72. It is contemplated that the first and second laterally extending vertical flanges 80, 82 can be co-planar and can either extend away from one another or toward one another to engage the two opposing co-extruded track members 72, respectively, depending upon the configuration of the co-extruded track members 72.

Figure 15:
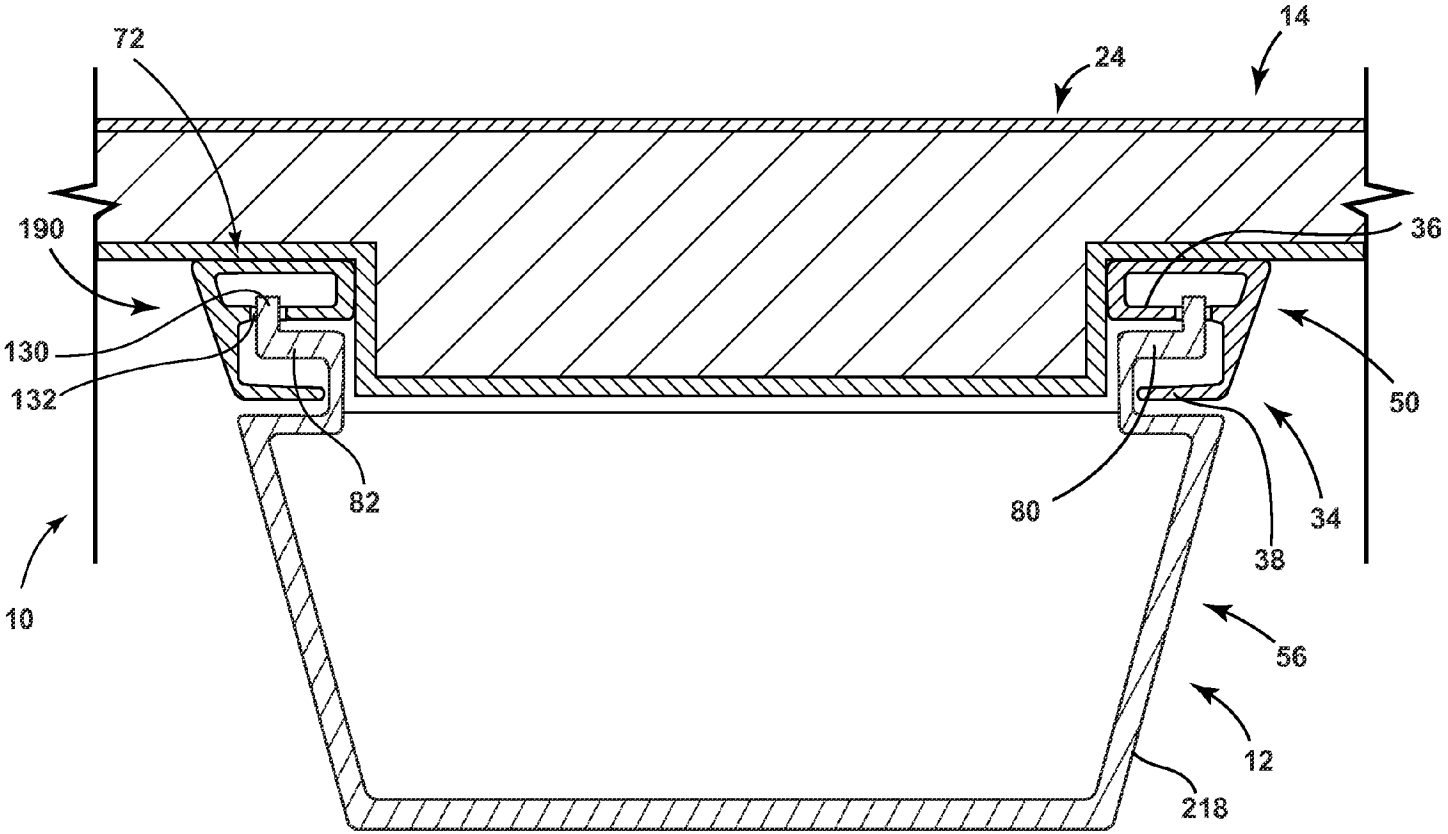
FIG. 15 is a cross-sectional view of the appliance door of FIG. 2, taken along line XV-XV.
Figure 16:
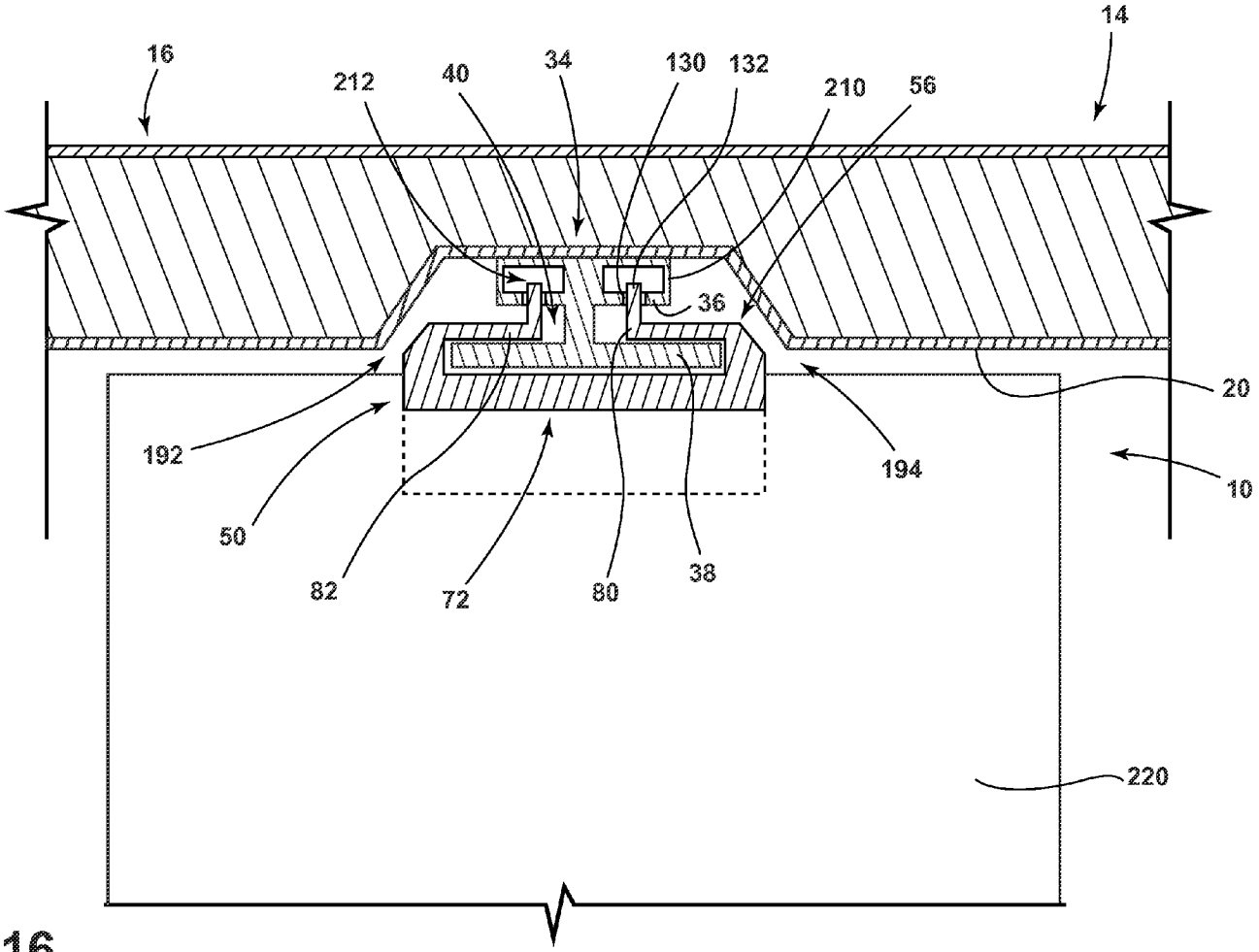
FIG. 16 is a cross-sectional view of the back wall of the appliance of FIG. 1, taken along line XVI-XVI.

In various embodiments, the co-extruded track members 72 can be positioned such that the vertical gaps 94 defined within each of the opposing co-extruded track members 72 can open toward one another (shown in FIG. 15). In such an embodiment, the first and second laterally extending vertical flanges 80, 82 would be configured to extend away from each other and in the same plane, such that the laterally extending vertical flanges 52 can extend through the vertical gaps 94 defined within the co-extruded track members 72. Alternatively, where the vertical gaps 94 defined within the opposing co-extruded track members 72 open away from one another (shown in FIG. 16), it is contemplated that the first and second laterally extending vertical flanges 80, 82 would extend toward one another within the same plane in order to extend into the vertical gaps 94 defined within the opposing co-extruded track members 72.

By way of illustration, and not limitation, as shown in FIGS. 1, 2 and 13-16, the storage members 12 disposed within the cabinet door 24 have first and second laterally extending vertical flanges 80, 82 that extend away from one another to engage outside mount 190 opposing co-extruded track members 72 having vertical gaps 94 that open toward one another. Alternatively, the concealed vertical adjustment mechanism 10 disposed within the back wall 20 of the appliance cabinet 16 may include a vertical adjustment mechanism 10 having an inside mount 192 where the vertical gaps 94 of the opposing co-extruded track members 72 open away from one another. This configuration can be useful in the setting illustrated in FIGS. 1 and 16 such that the engagement structure 50 of the storage member 12, in this case, storage shelves 220, can engage the back wall 20 of the appliance cabinet 16 proximate a concealing flange 38 at least partially defined by a cooling tower 194 of the kitchen appliance 14. In such an embodiment, the engagement structure 50 can be a bracket that engages the co-extruded track members 72 and also supports the storage shelf 220. This configuration provides the user, during normal use and viewing, with a shelf 220 or set of shelves 220 that appear to be suspended without visible attachment. Accordingly, the shelf 220 or shelves 220 appear to be suspended in the air without support, thereby providing to the user the illusion that the shelf 220 or set of shelves 220 are levitating within the appliance 14.

Referring again to FIGS. 4-8 and 13-14, the various protrusions 132 that extend from the engagement structure 50 can include three vertically aligned protrusions 132 that are separated by a first distance 200, with adjacent protrusions 132 being equidistant from one another. Similarly, the plurality of retaining apertures 130 of the retaining member 36 are spaced apart by a second distance 202, again, with adjacent retaining apertures 130 being equidistant. It is contemplated that the first distance 200 can be the same as the second distance 202, such that the adjustment of the storage member 12 can be made by increments of one retaining aperture 130 due to the equidistant nature of the protrusions 132 and the engagement apertures.

Figure 8:
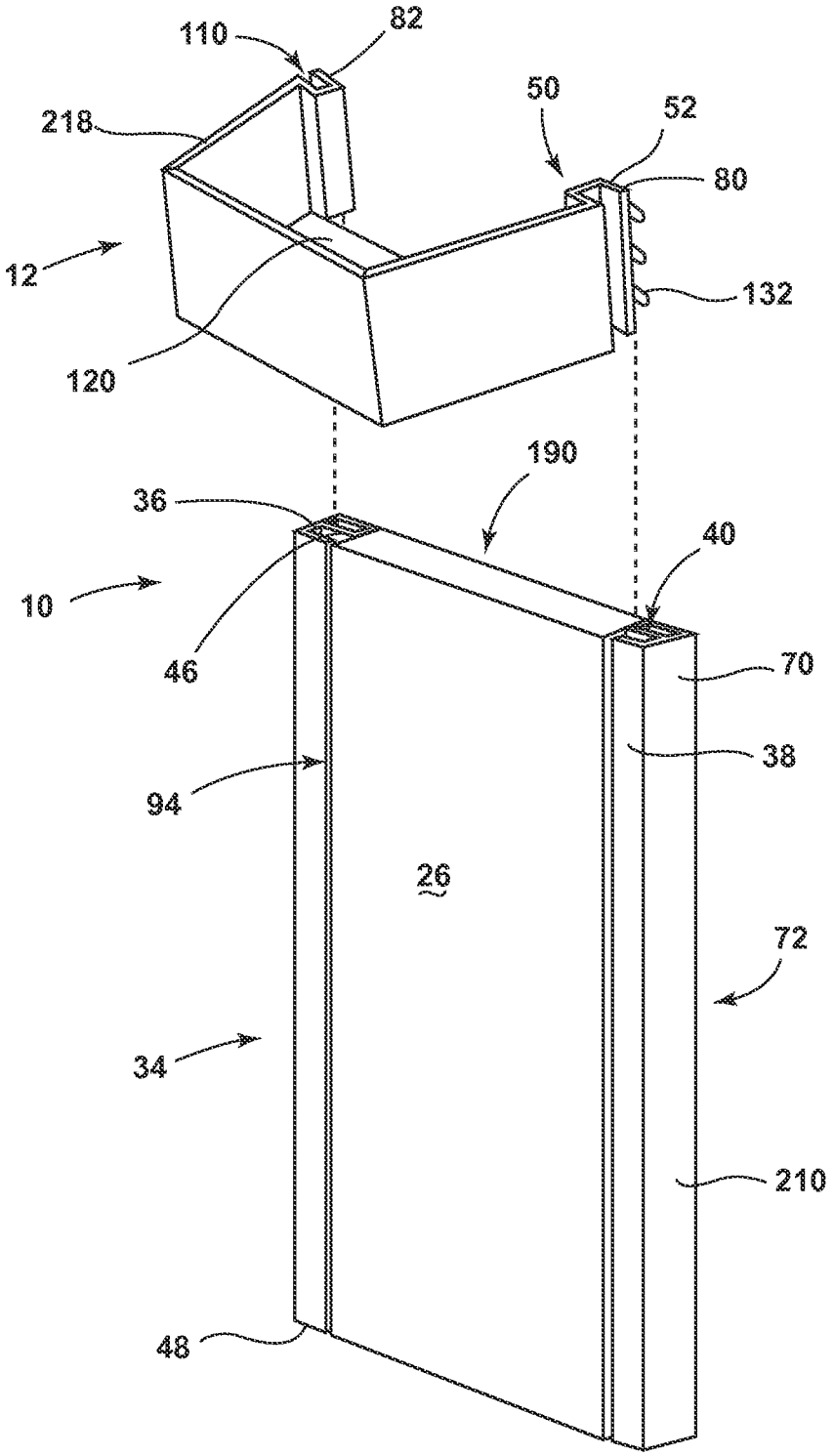
FIG. 8 is a partially exploded front perspective view of an embodiment of the vertical adjustment mechanism with the storage bin removed from the concealed vertical track system.
Figure 9:
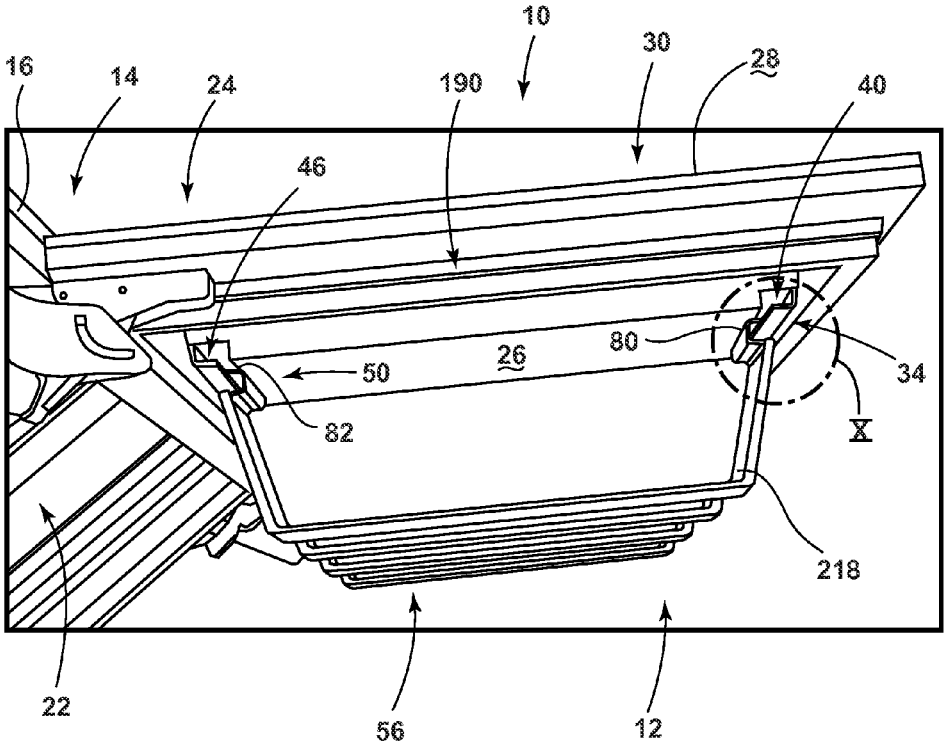
FIG. 9 is a top perspective view of an appliance incorporating another alternate embodiment of the concealed vertical adjustment mechanism.
Figure 10:
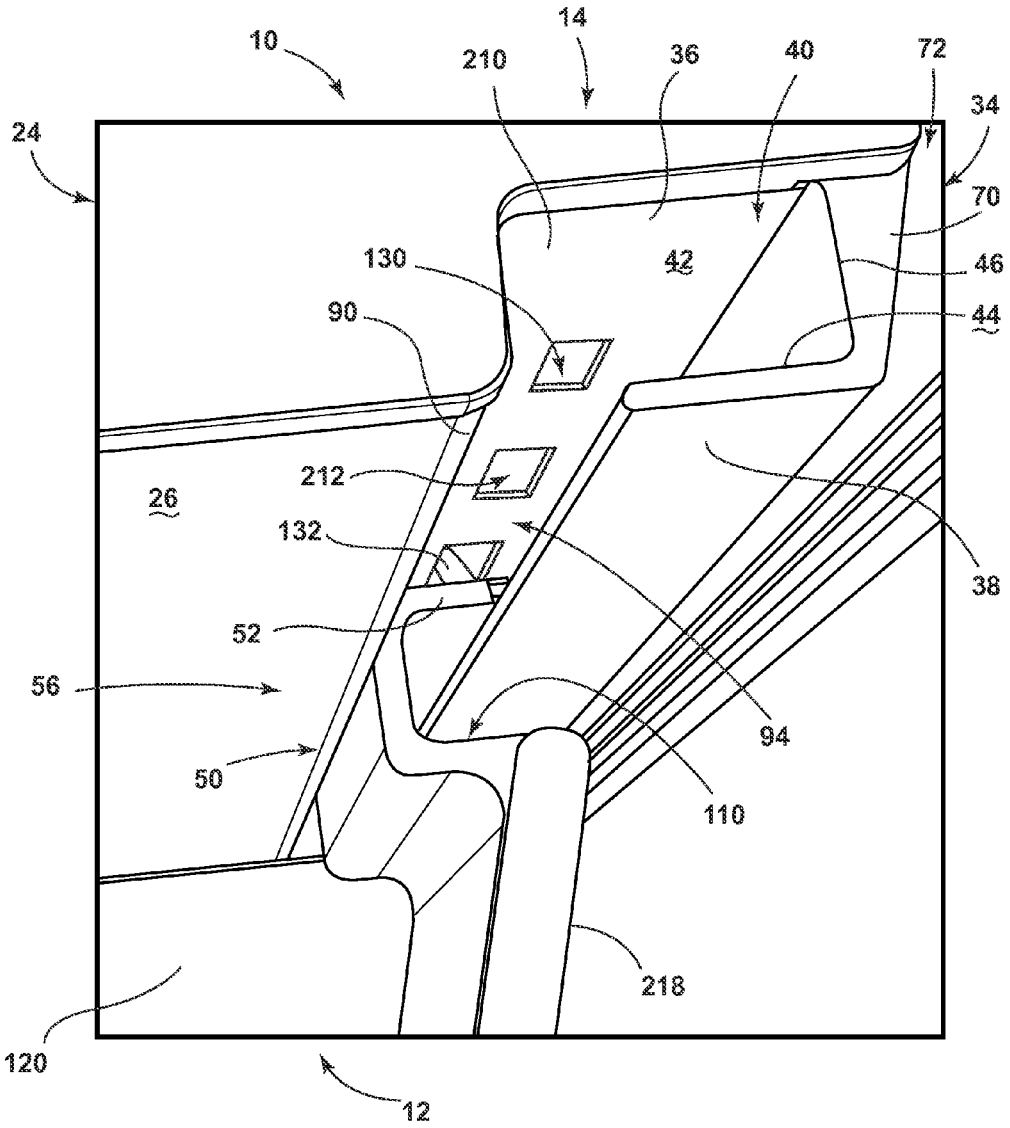
FIG. 10 is an enlarged top perspective view of the appliance door of FIG. 9.

Referring again to the embodiment illustrated in FIGS. 8-10, it is contemplated that the retaining member 36 can include an extruded tubular structure 210 that defines an inside space 212. It is contemplated that each of the vertically secured positions 56 can be defined by at least two vertically aligned protrusions 132 of the laterally extending vertical flange 52 extending at least partially into the inside space 212 of the extruded tubular structure 210. According to various embodiments, the extruded tubular structure 210 and the concealing flange 38 can be connected by the transition member 70, where the extruded tubular structure 210, the concealing flange 38, and the transition member 70 are part of the unitary co-extruded track member 72.

Referring again to FIGS. 4-8, it is contemplated that the various vertically aligned protrusions 132 that extend from the laterally extending vertical flange 52 can be substantially equal in size. It is also contemplated that the various vertically aligned protrusions 132 that extend from the laterally extending vertical flange 52 can be of different sizes and/or can include different spacing patterns. By way of example, and not limitation, it is contemplated that in embodiments where three vertically aligned protrusions 132 extend from the laterally extending vertical flange 52, the bottom most protrusion 132 can be larger than the topmost protrusion 132 with the central protrusion 132 having a size inbetween the largest and smallest such that the protrusions 132 are progressively smaller from the bottom to the top of the laterally extending vertical flange 52 (shown in FIGS. 11 and 12). In this embodiment, it is contemplated that less upward rotation 150 of the storage member 12 may be necessary in order to remove the various protrusions 132 of the laterally extending vertical flange 52 from the corresponding retaining apertures 130 of the retaining member 36. Such a configuration may provide for an adjustment region 40 having a thinner profile permitted by the progressively smaller configuration of the protrusions 132, such as a lesser distance between the retaining member 36 and the concealing flange 38.

It should be understood that the shape of the laterally extending vertical flange 52 and the protrusions 132 extending therefrom can vary among the various embodiments. The configuration of the laterally extending vertical flange 52 and the protrusions 132 can be any one or more of various shapes that can include, but are not limited to, arcuate, triangular, irregular, polygonal, or other similar shape, so long as the laterally extending vertical flange 52 can be manipulated between the vertical adjustment state 54, the plurality of vertically secured positions 56, and removed from or installed within the vertical track system 34.

According to various embodiments, it is also contemplated that the laterally extending vertical flange 52 can include different members that extend from the back surface of the laterally extending vertical flange 52 to engage the retaining member 36. In such an embodiment, it is contemplated that the laterally extending vertical flange 52 can include a protrusion 132 and a separate hook-type member that cooperate to retain the storage member 12 in a particular vertically secured position 56. Various combinations of retaining structures can be defined within the laterally extending vertical structure that can include, but are not limited to, protrusions 132, clasps, hooks, hasps, various structures allowing for mating engagement, and other similar retaining structures.

According to the various embodiments, it is contemplated that the concealed vertical adjustment mechanism 10 described herein can be used in various appliances that can include, but are not limited to, refrigerators, freezers, ovens, microwaves, dishwashers, and others. It is also contemplated that the concealed vertical adjustment mechanism 10 described herein can be used in other fixtures that can include, but are not limited to, cabinetry, millwork, shelving, seating, light fixtures, and other similar household fixtures.

According to the various embodiments, it is contemplated that the storage member 12 for the concealed vertical adjustment mechanism 10 can include various storage features that can include, but are not limited to, baskets, storage bins 218, storage shelves 220, drawer assemblies, various brackets, bottle holders, various other storage surfaces or storage containers, combinations thereof, and other similar storage features that can be disposed within various kitchen appliances 14 and household fixtures.

According to various embodiments, the various components of the concealed vertical adjustment mechanism 10 can be made of various substantially rigid materials that can include, but are not limited to, metals, metal alloys, plastic, composite, extrudable materials, ceramic, glass, wood, combinations thereof, and other similar rigid-type materials that can be used within kitchen appliances 14 and various household fixtures. According to the various embodiments, it is also contemplated that the concealed vertical adjustment mechanism 10 can be disposed within various settings in a separate directional orientation such as horizontal, diagonal, or other directional orientation to allow for the adjustment of various storage members 12 in any number of directions.

The invention claimed is:

1. A storage member vertical adjustment mechanism for a kitchen appliance, the storage member vertical adjustment mechanism comprising:

an appliance cabinet having a plurality of sidewalls and a back wall that define an interior volume;

a cabinet door having an interior surface and an exterior surface, the cabinet door coupled to the appliance cabinet and operable between open and closed positions, wherein the cabinet door in the closed position at least partially encloses the interior volume of the appliance cabinet such that the interior surface of the cabinet door further defines at least a portion of the interior volume;

a concealed vertical track system positioned proximate at least one of the back wall of the appliance cabinet and the interior surface of the cabinet door, the vertical track system including a retaining member and a concealing flange that extends parallel with the retaining member and at least partially conceals the retaining member when viewed from outside of the interior volume when the door is in the open position, wherein an adjustment region is defined between an outward surface of the retaining member and an inward surface of the concealing flange, the adjustment region including a top receiving aperture and a bottom receiving aperture; and a storage member having an engagement structure that cooperatively engages the adjustment region of the vertical track system, wherein the engagement structure includes a laterally extending vertical flange that engages at least one of the inward surface of the concealing flange and the outward surface of the retaining member to define a vertical adjustment state and alternatively engages the outward surface of the retaining member to define a plurality of vertically secured positions, wherein the vertical adjustment state and the plurality of vertically secured positions are defined by the concealing flange concealing the engagement structure from view, and wherein the retaining member and the concealing flange laterally support the laterally extending vertical flange within the adjustment region such that the engagement structure of the storage member can be selectively inserted and removed from the adjustment region only via at least one of the top and bottom receiving apertures, and wherein the retaining member includes an extruded tubular structure that defines an inside space, wherein the each vertically secured position is further defined by at least two vertically aligned protrusions of the engagement structure extending at least partially into the inside space of the extruded tubular structure and wherein the extruded tubular structure and the concealing flange are connected by a transition member, and wherein the extruded tubular structure, the concealing flange and the transition member are part of a unitary co-extruded track member.

2. The storage member vertical adjustment mechanism of claim 1, wherein the retaining member includes a plurality of retaining apertures defined therein, and wherein the at least two vertically aligned protrusions are selectively received by a portion of the plurality of retaining apertures to define the plurality of vertically secured positions, and wherein movement of the engagement structure to the adjustment state serves to disengage the at least two vertically aligned protrusions from corresponding retaining apertures such that the engagement structure can be vertically operated within the adjustment region.

3. The storage member vertical adjustment mechanism of claim 1, wherein each of the plurality of vertically secured positions is defined by the engagement structure being substantially parallel with the concealing flange and the retaining member, and wherein the adjustment state is defined by the engagement structure being rotated to be out of parallel with the concealing flange and the retaining member.

4. The storage member vertical adjustment mechanism of claim 1, wherein the retaining member and the concealing flange are connected by the transition member, and wherein the retaining member, the concealing flange and the transition member are part of the unitary co-extruded track member.

5. The storage member vertical adjustment mechanism of claim 4, wherein the concealed vertical track system includes two opposing co-extruded track members and wherein the engagement structure of the storage member includes first and second laterally extending vertical flanges that cooperatively engage the two opposing co-extruded track members, respectively.

6. The storage member vertical adjustment mechanism of claim 5, wherein the first and second laterally extending vertical flanges are co-planar and extend away from one another to engage the two opposing co-extruded track members, respectively, and wherein the storage member is a storage bin having a bracket that includes the engagement structure.

7. The storage member vertical adjustment mechanism of claim 2, wherein the at least two vertically aligned protrusions of the engagement structure includes three vertically aligned protrusions that are separated by a first distance, wherein the plurality of retaining apertures are spaced apart by a second distance, wherein the first distance is the same as the second distance, and wherein each of the vertically secured positions is further defined by the at least two vertically aligned protrusions of the three vertically aligned protrusions being engaged with corresponding retaining apertures, and wherein when the engagement structure defines the adjustment state when the at least two vertically aligned protrusions are out of engagement with the corresponding retaining apertures such that the engagement structure is substantially free to slidably operate within the adjustment region.

8. A storage member vertical adjustment mechanism comprising:

a concealed vertical track system configured to be incorporated into a kitchen appliance, the vertical track system including a retaining member and a concealing flange that cooperate to define an adjustment region, wherein a plurality of securing structures are defined within the retaining member and are in communication with the adjustment region, and wherein the retaining member and the concealing flange are positioned parallel with one another such that the concealing flange at least partially conceals the plurality of securing structures from view when viewed at a position substantially normal to an outer surface of the concealing flange, and wherein the concealing flange and retaining member cooperate to define first and second ends of the adjustment region; and at least one storage member having an engagement structure that cooperatively engages the adjustment region of the vertical track system, wherein the engagement structure includes a laterally extending vertical flange that engages at least one of an inward surface of the concealing flange and an outward surface of the retaining member to define a vertical adjustment state and alternatively engages a portion of the plurality of securing structures of the retaining member to define a plurality of vertically secured positions, wherein the vertical adjustment state and the plurality of vertically secured positions are defined by the concealing flange concealing the engagement structure from view, and wherein the retaining member and the concealing flange define a vertical slot through which the engagement structure can vertically operate within the adjustment region, the vertical slot having a slot width that is less than a thickness of the engagement structure such that the engagement structure of the at least one storage member is selectively inserted and removed from the adjustment region only via at least one of the first and second ends of the adjustment region, wherein the retaining member includes an extruded tubular structure that defines an inside space, wherein the each vertically secured position is further defined by at least two vertically aligned protrusions extending at least partially into the inside space of the extruded tubular structure, and wherein the extruded tubular structure and the concealing flange are connected by a transition member, and wherein the extruded tubular structure, the concealing flange and the transition member are part of a unitary and co-extruded track member.

9. The storage member vertical adjustment mechanism of claim 8, wherein the plurality of securing structures of the retaining member includes a plurality of retaining apertures defined therein, and wherein the at least two vertically aligned protrusions are selectively received by a portion of the plurality of retaining apertures to define the plurality of vertically secured positions, and wherein the engagement structure is moved from any one of the plurality of vertically secured positions to the adjustment state by rotating the engagement structure upward to disengage the at least two vertically aligned protrusions from the portion of the plurality of retaining apertures such that the engagement structure in the adjustment state can be vertically operated within the adjustment region.

10. The storage member vertical adjustment mechanism of claim 8, wherein the retaining member and the concealing flange are connected by the transition member, and wherein the retaining member, the concealing flange and the transition member are part of the unitary co-extruded track member.

11. The storage member vertical adjustment mechanism of claim 10, wherein the concealed vertical track system includes two opposing co-extruded track members and wherein the engagement structure of the storage member includes first and second laterally extending vertical flanges that are co-planar and extend toward one another to cooperatively engage the two opposing co-extruded track members, respectively.

12. The storage member vertical adjustment mechanism of claim 9, wherein the at least two vertically aligned protrusions of the engagement structure includes three vertically aligned protrusions that are separated by a first distance, wherein the plurality of retaining apertures are spaced apart by a second distance, wherein the first distance is the same as the second distance, and wherein each of the vertically secured positions is further defined by the at least two vertically aligned protrusions of the three vertically aligned protrusions being engaged with corresponding retaining apertures, and wherein when the engagement structure defines the adjustment state when the engagement structure is rotated relative to the retaining member such that the at least two vertically aligned protrusions are out of engagement with the corresponding retaining apertures such that the engagement structure is substantially free to slidably operate within the adjustment region.

13. The storage member vertical adjustment mechanism of claim 12, wherein the three vertically aligned protrusions are at least substantially identical to one another in shape and size.

14. The storage member vertical adjustment mechanism of claim 8, wherein the storage member is a storage shelf having a bracket that includes the engagement structure.

15. A storage member vertical adjustment mechanism for a kitchen appliance, the storage member vertical adjustment mechanism comprising:

an appliance cabinet having a plurality of sidewalls and a back wall that define an interior volume;

a cabinet door having an interior surface and an exterior surface, the cabinet door coupled to the appliance cabinet and operable between open and closed positions, wherein the cabinet door in the closed position encloses the interior volume of the appliance cabinet such that the interior surface of the cabinet door further defines the interior volume;

a concealed vertical track system positioned within at least one of the back wall of the appliance cabinet, a sidewall of the appliance cabinet and the interior surface of the cabinet door, the vertical track system including a retaining member, a concealing flange and a transition member that extends between the retaining member and the concealing flange, wherein the concealing flange is positioned offset from and parallel with the retaining member and at least partially conceals the retaining member at least when viewed from outside of the interior volume when the cabinet door is in the open position, wherein an adjustment region having a vertical gap and top and bottom receiving apertures is defined by the retaining member and the concealing flange; and a storage member having an engagement structure that cooperatively engages the adjustment region of the vertical track system, wherein the engagement structure includes a laterally extending vertical flange configured to be inserted into and removed from the adjustment region via at least one of the top and bottom receiving apertures, wherein when the laterally extending vertical flange is positioned within the adjustment region, the laterally extending vertical flange extends through the vertical gap to a storage portion of the storage member such that the laterally extending vertical flange is laterally secured within the adjustment region, wherein the laterally extending vertical flange engages an outward surface of the retaining member to define a plurality of vertically secured positions, and wherein the laterally extending vertical flange is operable toward an inward surface of the concealing flange to define an adjustment state wherein the laterally extending vertical flange is vertically operable within the adjustment region and laterally operable within the adjustment region into any one of the vertically secured positions, wherein the vertical adjustment state and the plurality of vertically secured positions are each defined by the concealing flange concealing the laterally extending vertical flange from view, and wherein the retaining member includes an extruded tubular structure that defines an inside space, wherein the each vertically secured position is further defined by at least two vertically aligned protrusions extending at least partially into the inside space of the extruded tubular structure, and wherein the extruded tubular structure, the concealing flange and the transition member are part of a unitary and co-extruded track member.

16. The storage member vertical adjustment mechanism of claim 15, wherein the retaining member includes a plurality of retaining apertures defined therein, and wherein the laterally extending vertical flange includes the at least two vertically aligned protrusions that are selectively received by a portion of the plurality of retaining apertures to define the plurality of vertically secured positions, and wherein the engagement structure is moved from any one of the plurality of vertically secured positions to the adjustment state by rotating the engagement structure upward to disengage the at least two vertically aligned protrusions from the portion of the plurality of retaining apertures such that the engagement structure in the adjustment state can be vertically operated within the adjustment region.

17. The storage member vertical adjustment mechanism of claim 16, wherein the at least two vertically aligned protrusions includes three vertically aligned protrusions that are separated by a first distance, wherein the plurality of retaining apertures are spaced apart by a second distance, wherein the first distance is the same as the second distance, and wherein each of the vertically secured positions is further defined by the at least two vertically aligned protrusions of the three vertically aligned protrusions being engaged with corresponding retaining apertures, and wherein when the engagement structure is moved to the adjustment state by rotating the engagement structure relative to the retaining member such that the at least two vertically aligned protrusions are rotated out of engagement with the corresponding retaining apertures such that the engagement structure is substantially free to slidably operate within the adjustment region.

* * * * *